US007832596B2

(12) United States Patent
van der Klaauw et al.

(10) Patent No.: US 7,832,596 B2
(45) Date of Patent: Nov. 16, 2010

(54) TAPPING ROD

(75) Inventors: Guido Petrus Johannes van der Klaauw, Zoeterwoude (NL); Bart Jan Bax, The Hague (NL); Marius Corstiaan van Duuren, Poortugaal (NL); Arie-Maarten Paauwe, De Lier (NL)

(73) Assignee: Heineken Technical Services B.V., Amsterdam (NL)

( * ) Notice: Subject to any disclaimer, the term of this patent is extended or adjusted under 35 U.S.C. 154(b) by 236 days.

(21) Appl. No.: 10/432,677

(22) PCT Filed: Nov. 21, 2001

(86) PCT No.: PCT/NL01/00847

§ 371 (c)(1),
(2), (4) Date: Sep. 23, 2003

(87) PCT Pub. No.: WO02/48019

PCT Pub. Date: Jun. 20, 2002

(65) Prior Publication Data

US 2004/0045988 A1 Mar. 11, 2004

(30) Foreign Application Priority Data

Nov. 23, 2000 (NL) ..... 1016687

(51) Int. Cl.
*B67D 1/12* (2006.01)

(52) U.S. Cl. ..... 222/400.8; 222/394; 137/212; 137/322

(58) Field of Classification Search ..... 222/400.7, 222/394, 398, 399, 400.8; 137/212, 317–325, 137/614.03–614.06; 141/44, 59, 346, 348, 141/349; 251/321
See application file for complete search history.

(56) References Cited

U.S. PATENT DOCUMENTS

| | | | | |
|---|---|---|---|---|
| 3,473,556 | A | 10/1969 | Johnson et al. | |
| 3,868,049 | A | 2/1975 | Johnston | |
| 4,291,821 | A * | 9/1981 | Nezworski | 222/153.04 |
| 4,305,421 | A * | 12/1981 | Fallon | 137/322 |
| 5,199,609 | A * | 4/1993 | Ash, Jr. | 222/94 |
| 5,511,692 | A * | 4/1996 | Willingham | 222/1 |
| 5,944,229 | A * | 8/1999 | Rokkjaer | 222/153.07 |

FOREIGN PATENT DOCUMENTS

| | | |
|---|---|---|
| NL | 1 012 546 | 1/2000 |
| NL | 1 014 081 | 6/2000 |
| WO | WO 00/03944 | 1/2000 |

* cited by examiner

*Primary Examiner*—J. Casimer Jacyna
(74) *Attorney, Agent, or Firm*—Pearne & Gordon LLP

(57) ABSTRACT

A tapping rod (2) with a beverage valve (16), a gas valve (14) cooperating therewith, and a collar (24), while in or on the collar a connecting device (26) is fitted, which connecting device comprises a pressure body (30) for opening the beverage valve (16) and the gas valve (14), wherein: the pressure body (30) comprise or defines at least one first beverage channel (50) for bringing, with the beverage valve in open position, the inner space of a keg, in particular a riser of the taping rod, into fluid communication with a beverage dispensing line; the pressure body comprises or defines at least one gas channel (48) for bringing, with the gas valve in open position, the inner space of the keg into fluid communication with a gas supply line.

26 Claims, 14 Drawing Sheets

TAPPING ROD

FIELD OF THE INVENTION

This invention relates to a tapping rod with a beverage valve, a gas valve cooperating therewith, and a collar. Such a tapping rod is known from practice and is used, for instance, in beer kegs and like containers for beverage, in particular carbonated beverage.

DESCRIPTION OF RELATED ART

In the known tapping rod, there is provided a substantially cylindrical chamber with a collar, with an upper end of a riser extending concentrically in the chamber. Within the end of the riser located in the chamber, a beverage valve is provided, which is round and cup-shaped. An annular gas valve is arranged concentrically on the upper side of the beverage valve and in closed position abuts against the outer longitudinal edge of the beverage valve, while the gas valve sealingly abuts against an outwardly flanged upper longitudinal edge of the upper end of the riser. The outer longitudinal edge of the annular gas valve in the closed position abuts sealingly against a valve seat at the underside of the collar. In the riser, a first spring is provided which presses the beverage valve against the gas valve, while between the riser and the chamber a second spring is arranged, which abuts on one side against said flanged longitudinal edge of the riser and on the other side against a looking plate at the bottom of the chamber, so that the gas valve is pressed against the valve seat. Thus, the beverage valve and the gas valve are both closed.

This tapping rod is conventionally screwed into a neck of a keg, such that the riser extends within the keg, as, far as a point adjacent the bottom thereof. If a keg is connected to a tapping installation, i.e. is broached, the tapping head is fixed onto the neck and with a handle a pressure body is depressed. The pressure body comprises a first pressure part which can be moved through the opening in the annular gas valve against the beverage valve and can move the beverage valve away from the gas valve, while a second pressure part is provided which can press the gas valve away from the seat. Thus, with the tapping head the two valves can be opened.

In this known tapping head, a first beverage channel is provided which is fixedly connected with a beverage line of the tapping device, while a gas channel is provided which is fixedly connected with a source for pressure gas, such as a $CO_2$ cylinder. When a keg has been broached, beverage can be pressed from the keg into the beverage line by introduction of gas into the keg through the gas channel. When uncoupling the keg, beverage can flow from the beverage channel into the gas channel, which is undesirable. Further, in principle, every time, at least very regularly, for instance each time when a new keg is broached, at least the beverage line and the tapping head are to be cleaned, certainly when the tapping device is not going to be used for a longer time, for instance during closing hours of bars, restaurants, etc. Such cleaning is time-consuming and environment-unfriendly, as well as costly. A further disadvantage of this known tapping rod is that the tapping head to be used therewith is little handy in use in that at least two lines are, and remain, connected to it, also when changing a keg.

SUMMARY OF THE INVENTION

The object of the invention is to provide a tapping rod of the type described in the preamble, in which the disadvantages mentioned are avoided, while maintaining the advantages thereof. To that end, a tapping rod according to the invention is characterized by the features according to the claims as follows.

In a tapping rod according to the invention, a connecting device is provided on or within the collar, against or near the gas valve and/or the beverage valve. The pressure body is then ranged for, on the one hand, opening the beverage valve and the gas valve and, on the other, keeping separate, at least in the connecting device, the or each beverage channel, at least a beverage line connecting thereto during use, and the or each gas channel, preferably both with the valves open and with the valves closed. The connecting device is supplied and removed along with the tapping rod, whilst the tapping head is only connected with the gas line. The beverage line is or can be connected with the connecting device, so that during use contact between the beverage and the tapping head is avoided entirely. This provides the advantage that the tapping head substantially does not need to be cleaned. Moreover, as a result, the tapping head has become easier to handle.

In a tapping rod according to the present invention, the beverage valve and the gas valve are covered by the connecting device, also during storage and transport. As a result, contamination of the valves can be better prevented and the tapping rod is suitable for use with a special tapping head, viz. one with which only the gas line is connected, not the tapping line. Thus, it is ensured that in each case a suitable keg is broached, since kegs without the specific connecting device cannot be connected to the is respective tapping device. Thus, authenticity of the product supplied can be ensured still better in a relatively simple manner. Moreover, connecting faults are avoided.

In a first advantageous embodiment, a tapping rod according to the invention is characterized by the features of the claims as follows.

In this embodiment, the connecting device is substantially built up from two elements, a fixing element and the pressure body, which both comprise a beverage channel, which beverage channels link up with each other when the valves are open. Thus, the advantage is achieved that a beverage dispensing line can be fixedly connected with the second beverage channel and does not need to move along with the pressure body. Thus, a connecting device with a relatively small overall height is obtained.

In an alternative embodiment, a tapping rod according to the invention is characterized by the features according to the claims as follows.

In such an embodiment, the beverage dispensing line will move along with the pressure body, so that the chance of leaks is further reduced.

In a further particularly advantageous embodiment, a tapping rod according to the invention is further characterized by the features according to the claims as follows.

In such an embodiment, the connecting device, as pressure body, can be made substantially of one-piece design, so that a particularly simple and reliable device is obtained. Moreover, such a connecting device, at least pressure body, is relatively cheap to manufacture and simple to fit, while assembly faults are prevented still better, since assembly in the case of such a connecting device is not needed, with the exception of a beverage dispensing line fixedly connected therewith, if any, which is to be fitted.

In a further alternative embodiment, a tapping rod according to the invention is further characterized by the features according to the claims as follows.

In such an embodiment, the connecting device can again be manufactured in one piece, apart from the beverage dispensing line to be fixedly fitted, if any, which is then to be connected, whilst a relatively simple valve assembly is used since it has only one movable part which can close or clear both the gas passage and the beverage passage. The locking ring and the locking plate can then be disposed approximately in the same plane, as well as the upper side of the valve body in closed position. As a result, a relatively flat upper side is obtained which is little susceptible to trouble and simple to clean. Precisely in combination with a one-piece connecting device as described here, this is advantageous, the more so since such a connecting device only needs to have a particularly small overall height.

The invention further relates to a keg, provided with a tapping rod according to the invention.

The invention additionally relates to an assembly of a keg according to the invention and a tapping head, characterized by the features according to the claims as follows.

With such a tapping head, in a particularly simple manner, a keg according to the invention can be broached and be made ready for use.

The invention further relates to a method for use of a keg with a tapping rod, characterized by the features according to the claims as follows.

With such a method, in a particularly simple and effective manner, a keg can be broached, whilst undesired mixing of beverage and pressure gas, that is, elsewhere than in the keg, is prevented. Moreover, with such a method, the use is considerably simplified, since cleaning can be substantially dispensed with.

The invention further relates to a connecting device for use with a tapping rod, keg, assembly or method according to the invention.

The invention furthermore relates to an apparatus for making a keg of beverage ready, characterized by the features according to the claims as follows.

With such an apparatus, in a simple manner, kegs can be filled and be provided with tapping rods, whilst in each case a connecting device according to the invention is fitted, covered by a covering means, for instance a sealing means, so that authenticity thereof can be ensured still better.

Further advantageous embodiments of a tapping rod, keg, assembly, method, connecting device and apparatus for making kegs of beverage ready are given in the subclaims.

BRIEF DESCRIPTION OF THE DRAWINGS

To clarify the invention, exemplary embodiments thereof will be described in more detail, with reference to the drawing. In the drawing.

DETAILED DESCRIPTION OF THE PREFERRED EMBODIMENTS OF THE INVENTION

Figure 1:
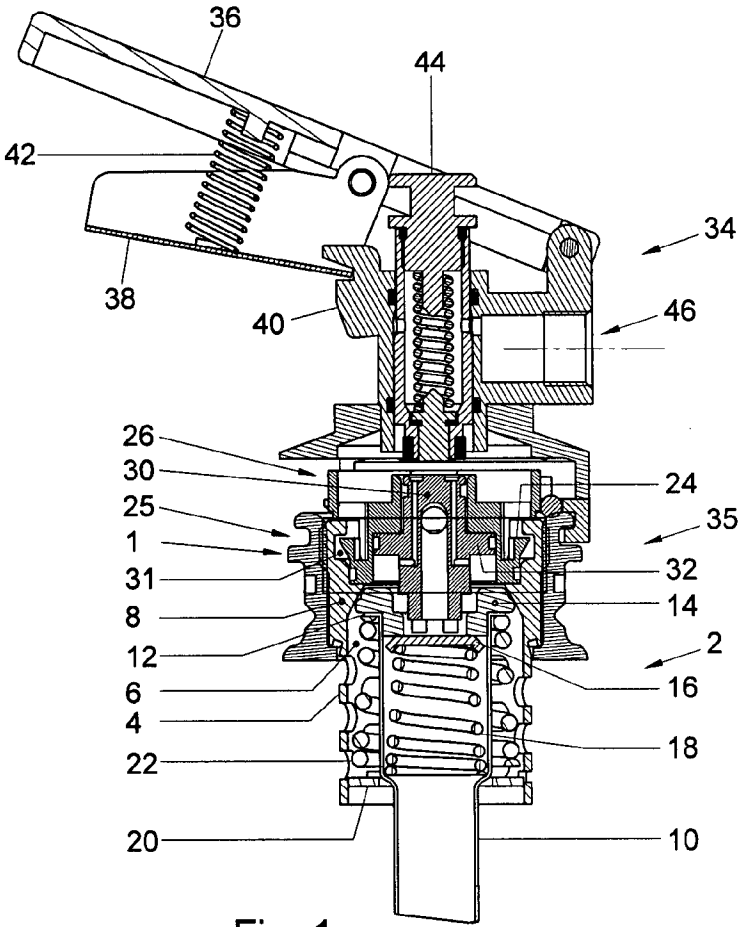
FIG. 1 shows an upper part of a tapping rod in the neck of a keg with a tapping head, in closed condition.

In this description, the same or corresponding parts have the same or corresponding reference numerals. In this description, the starting point will be a beer keg with associated tapping device. However, a tapping rod according to the invention, as well as a method according to the invention, can also be used for other beverages, in particular carbonated beverages. In this description, the tapping head and the keg will be described only to a limited extent, as far as useful for a better understanding of this invention. The same applies to the valve mechanisms used. Such tapping heads, kegs and valve mechanisms are sufficiently known from practice, in particular for use with beer tapping devices.

In FIG. 1 there is shown a neck 1 of a beer keg, in which neck 1 a tapping rod 2 has been screwed or otherwise fixed. The tapping rod comprises a cylindrical housing 4, which defines a chamber 6, bounded at the top by a valve seat 8. Arranged within the chamber 6 is a riser 10, which extend downwards into the keg. The part extending outside the chamber 6 is reduced. The upper longitudinal edge 12 of the riser 10 is flanged outwards. Confined between the longitudinal edge 12 and the valve seat 8 is a substantially annular gas valve 14, which has a lower edge disposed with a proper fit within the riser 10. Disposed against the underside of the gas valve 14 is a cup-shaped beverage valve 16, which is sealingly pressed against the gas valve 14 by a first spring 18, confined in the wide part of the riser 10. The chamber 6 is closed off at the underside by a locking plate 20. Provided between the locking plate 20 and the longitudinal edge 12 is a second spring 22, which presses the gas valve against the valve seat 8. In this condition, both the gas valve 14 and the beverage valve 16 are closed.

Figure 2:
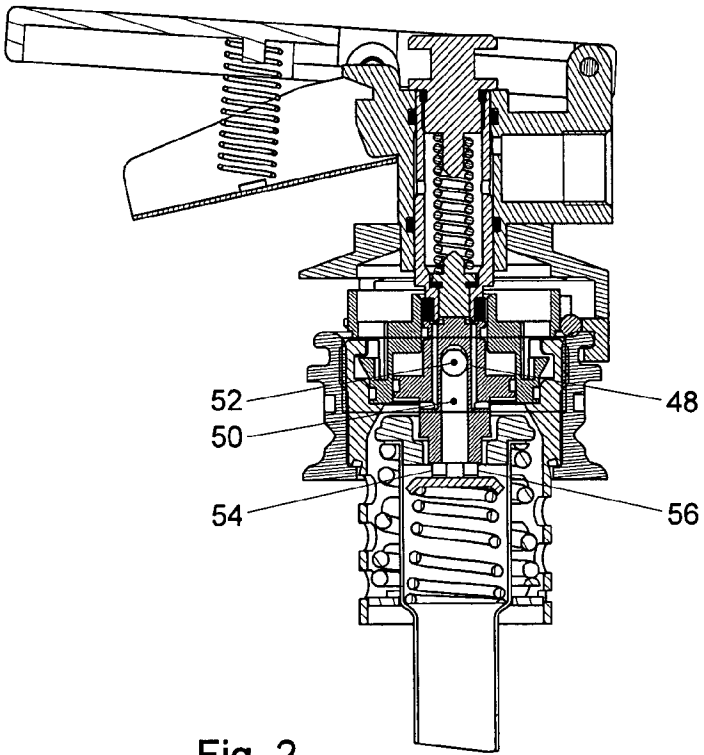
FIG. 2 shows the assembly according to FIG. 1, in open position.

Locked in the collar 24 of the tapping rod 2 is a connecting device 26 which is fixed with clamping fingers 28 in a circumferential groove 30. This connecting device 26 comprises a pressure body 30, movable in axial direction within a fixing body 32. On the neck 1, a tapping head 34 has been secured, provided with an operating rod with which the pressure body 30 can be moved relative to the fixing body 32, against the beverage valve 16 and the gas valve 14, as shown in FIG. 2, To that end, the handle 36 is moved downwards, with a blocking handle 38 being secured under a projection 40. Provided between the handle 36 and the blocking handle 38 is a tension spring 42 to prevent unintentional operation of the tapping head. The tapping head 34 has been fixed in a slot 25 in the neck 1 through a substantially horseshoe-shaped shoe 35, over the connecting device 26. With the handle 386, the operating rod 44 of the tapping head 34 is moved against the pressure body 30, which is thereby pressed down. By the pressure body 30, first the beverage valve 16 is moved away from the gas valve 14, whereafter upon further movement the gas valve 8 is pushed from the seat 8 by a wider part of the pressure body 30. The tapping head 34 is provided with a gas inlet 46, connectable to a $CO^2$ or like pressure gas source, from which gas inlet 46 gas can flow along the operating rod 44 to the pressure body 30. In the pressure body 30 gas channels 48 are provided, through which, with the valve open as shown in FIG. 2, gas can flow from the gas inlet 46, between the gas valve 14 and the seat 8, to the inside of the keg. In the pressure body 30, a first beverage channel 50 is provided, which has a radial outlet 52, as well as an axial beverage inlet 54 facing in the direction of the keg. Arranged around the beverage inlet 54 are square tooth-shaped elements 56, which keep the beverage inlet 54 spaced from the beverage valve 16, so that between the square tooth-shaped elements beverage can flow into the beverage channel 50, in the direction of the beverage dispensing line 52. As will be described in more detail, various packings are provided, as a result of which the beverage channel 50 and the gas channels 48 are separated from each other, so that contamination is simply prevented.

Figure 3:
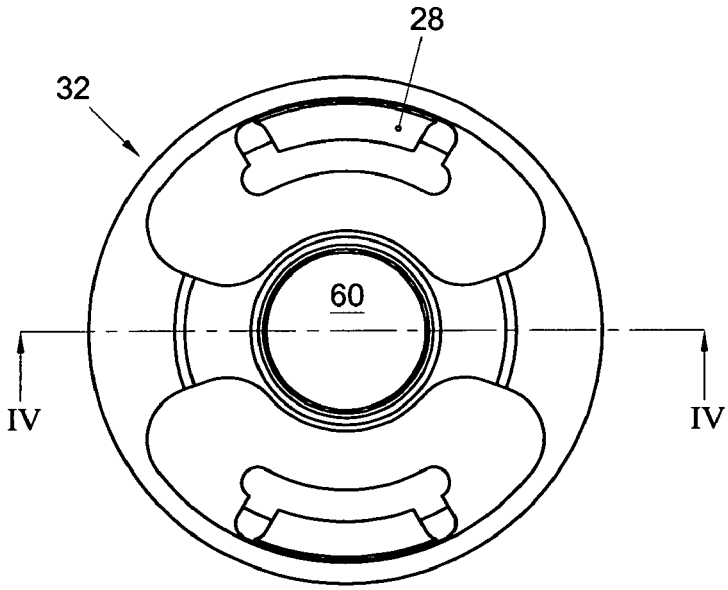
FIG. 3 shows, in top plan view, a fixing body of a connecting device according to the invention.
Figure 4:
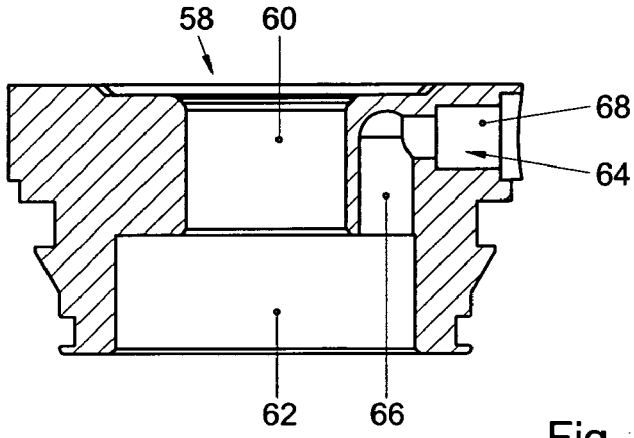
FIG. 4 shows the fixing body in sectional side elevation along the line IV-IV in FIG. 3.
Figure 5:
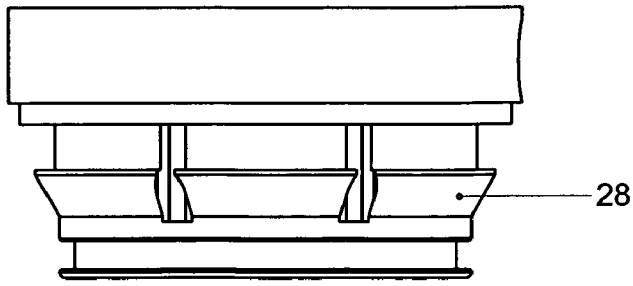
FIG. 5 shows a fixing body according to FIG. 3 in side elevation.

In FIGS. 3-5, a fixing body for a dispensing device according to FIGS. 1 and 2 is shown. This fixing body is preferably manufactured from recyclable plastic. The fixing body 32 is substantially annular and is provided along its longitudinal edge with projections 28 which can engage in the groove 30. These projections 28 are somewhat flexible, such that they can be pressed into said groove 30, whilst removal is simply prevented owing to the shape of the projections. The fixing body comprises a central bore 58 with a narrow first part 60 and, linking up therewith, a concentric second part 62, disposed lower down in use. A second beverage channel 64 is somewhat elbow-shaped and has a first leg 66 linking up with the wide second part 62, whilst in the second leg 68, a beverage dispersing line (not shown) can be inserted and fixed, for be. instance by gluing, welding or the like. This beverage dispensing channel is preferably a flexible tube.

Figure 8:
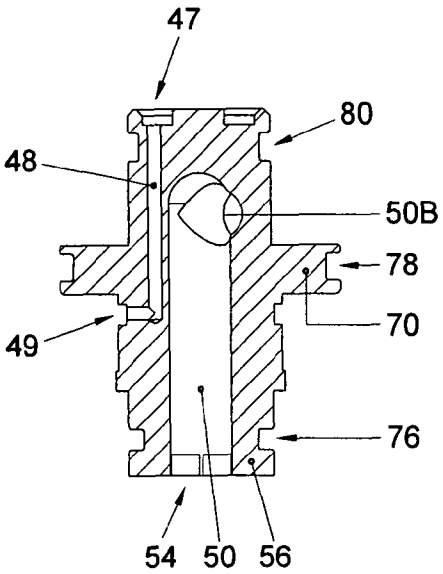
FIG. 8 shows, in sectional side elevation, a pressure body along the line VIII-VIII in FIG. 6.
Figure 7:
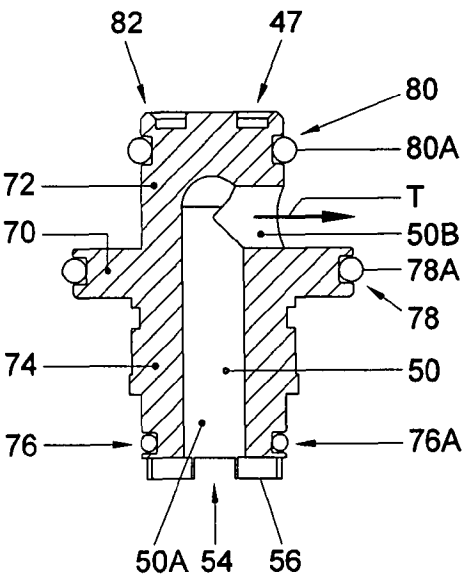
FIG. 7 shows, in sectional side elevation, a pressure body along the line VII-VII in FIG. 6.
Figure 6:
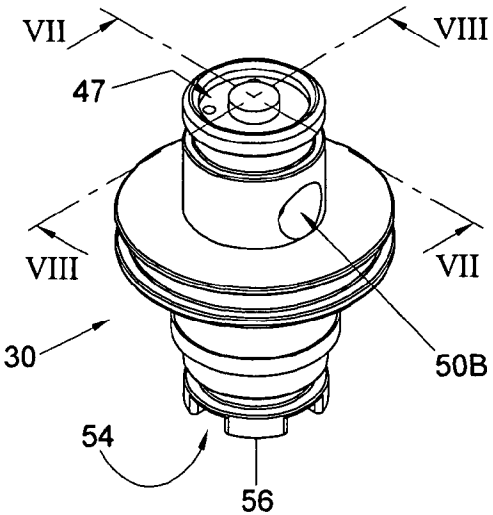
FIG. 6 shows, in perspective plan view, a pressure body according to the invention for use with a fixing body according to FIGS. 3-5.

In FIGS. 6-8, there is shown a pressure body 30 for use with a fixing body 32 according to FIGS. 3-5. The pressure body 30 is substantially cylindrical and comprises adjacent a middle part thereof an outwardly extending flange 70. Centrally in the pressure body 30 extends the first beverage channel 50, which is likewise somewhat elbow-shaped, having a first leg 50*a* extending coaxially in the pressure body 30, whilst a second leg 50*b* extends at right angles thereto. The second leg 50*b* terminates in the cylindrical first part 72 above the flange 70; the first leg 50*a* terminates in the second cylindrical part 74 under the flange 70. Adjacent the lower longitudinal edge of the second cylindrical part 74, a first packing 76A is placed in a packing groove 76; in the outer edge of the flange a second packing 78A is placed in a second packing groove 78, while adjacent the upper longitudinal edge of the fist cylindrical part 72 a third packing groove 80 is provided for a third packing 80A. The cross section of the first part 72 is selected such that it can be received with a proper fit in the first part 60 of the central bore 58, while the flange 70 can be received with a proper fit in the second part 62 of the central bore 58 of the fixing body 32. The packings in the second and third packing grooves 78, 80 are in sliding and sealing engagement with the respective walls of the parts 60, 62. Two gas channels 48 extend from a gas inlet 47 in the upper surface 82 of the pressure body as far as a gas outlet 49 directly under the flange 70. The second cylindrical part 74 of the pressure body 30 can then be in proper and sealing engagement within the annular opening in the gas valve 14.

Figure 9:
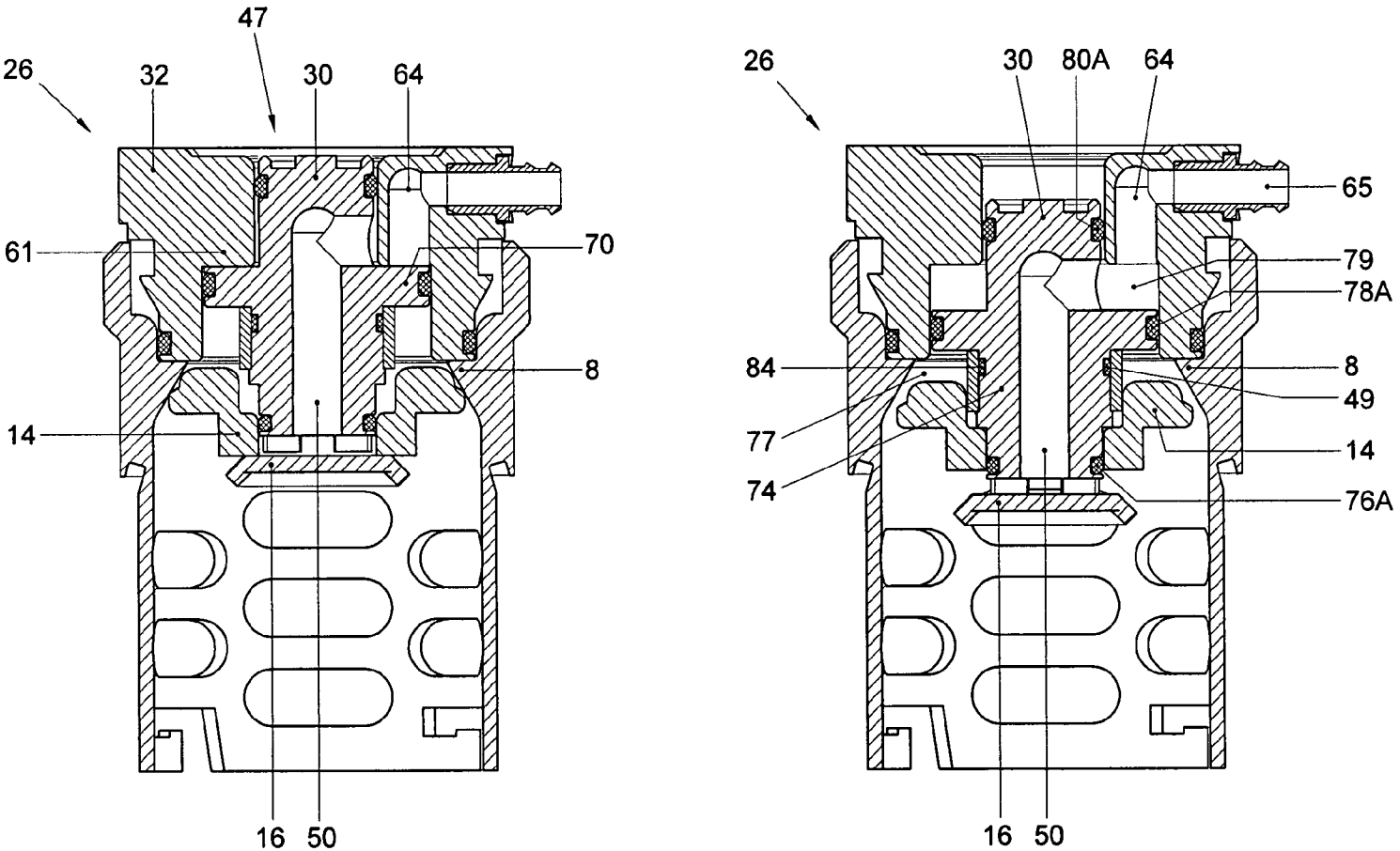
FIG. 9 shows, in sectional side elevation, a connecting device according to the invention, received in the neck of a tapping rod.

FIG. 9 on the left-hand side shows the connecting device 26 according to FIG. 1 in closed condition, while FIG. 9 on the right-hand side shows the same connecting device in open condition, as shown in FIG. 2. For the sake of clarity, the riser has been omitted.

As appear, from FIG. 9, on the left-hand side, the pressure body 30 has been moved up completely, such that the flange 70 abuts against the shoulder 61, formed as a transition between the first part 60 and the second part 62 of the central bore 58. The second beverage channel 64 is thereby closed and separated from the first beverage channel 50, while the beverage valve 16 sealingly abuts against the gas valve 14, which, in turn, abuts sealingly against the seat 8. Thus, the two valves are closed. As appears from FIG. 9 on the right-hand side, upon downward movement of the pressure body 30, the beverage valve 16 is moved away from the gas valve 14, while the gas valve 14 is moved away from the seat 8. Enclosed between the first packing 76A and the second packing 78A is a gas chamber 77; enclosed between the second packing 78A and the third packing 80A is a beverage chamber 79, which connects the first beverage channel 50 with the second beverage channel 64. In FIG. 9, in the second leg 66 of the second beverage channel 64, a connecting stub 65 is shown, for connecting the beverage dispensing line. The gas chamber 77 and beverage chamber 79 are strictly separated from each other. In this embodiment, around the second part 74 of the pressure body 30, an elastic, annular element 84 is provided, which surrounds the gas outlet openings 49 and functions as a non-return valve. This elastic element 84 is chosen such that when in the gas channel no gas pressure, at least a low gas pressure, prevails, the gas outlet openings 49 are closed thereby, while this element 84 can be pushed away by the gas pressure to clear the gas outlet 49. This prevents the possibility of beverage unintendedly flowing into the gas channel 48 in the event of gas pressure falling out.

Figure 9A:
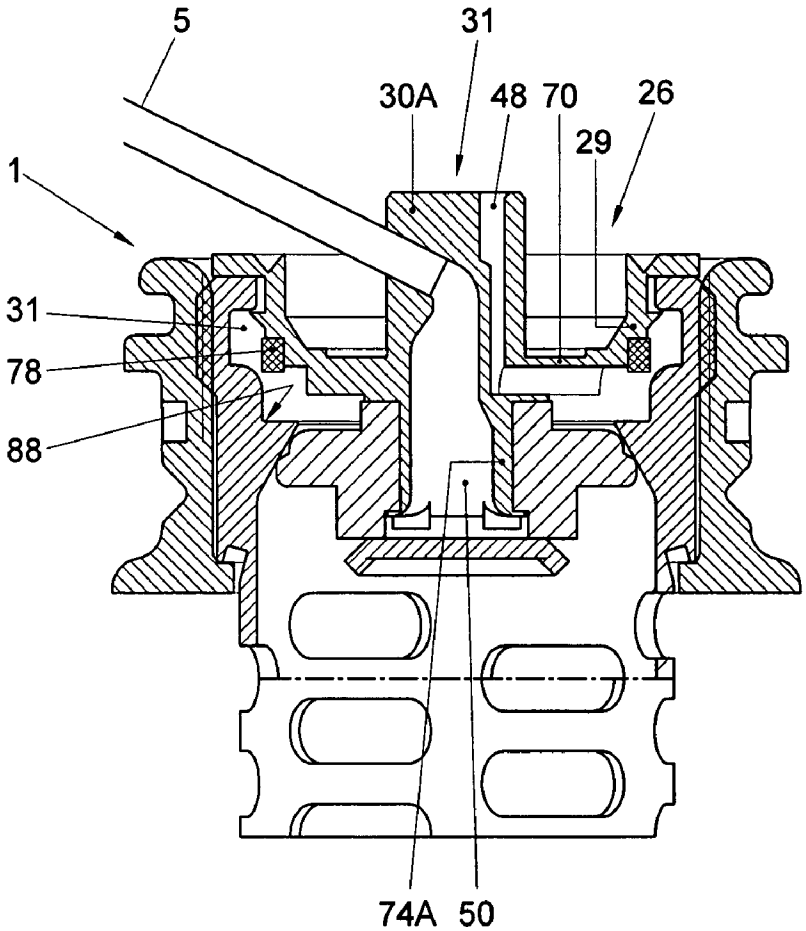
FIG. 9A shows a connecting device according to the invention in an alternative embodiment, received in a neck of a tapping rod, in cross section.

FIG. 9A shows an alternative embodiment of a connecting device 26 according to the invention, in which the pressure body and fixing body have been integrated into a single part 31. A cylindrical central part 30A is provided, which, adjacent the middle, viewed axially, is provided with a radially extending flange 70, provided at the outer longitudinal edge with a circumferential clicking edge 29. This clicking edge 29 engages in the groove 31 and has such a height as to permit axial movement of the connecting device 26, limited by the height of the groove 31 and the edge 29. Incorporated in the cylindrical part 30A is a beverage channel 50, as well as a gas channel 48. In FIG. 9A, again, the riser has been omitted, as well as the gas valve. In this embodiment, the beverage dispensing line 5 links up with the beverage channel 50 at an angle of, for instance, 120°, so that it does not run against the neck 1 of the keg. Provided along the outer edge of the flange 70 is a packing 78A, capable of sealing engagement with the wall part 88 of the neck 1 that extends under the groove 31, such that a gas and liquid tight sealing is obtained. The cylindrical part 74*a* extending under the flange 70 corresponds substantially to the lower cylindrical part 74 of the pressure body 30 according to FIGS. 6-8 and functions in the same way. In this embodiment, the whole connecting device 26 moves axially upon opening and closing of the valves.

Figure 10:
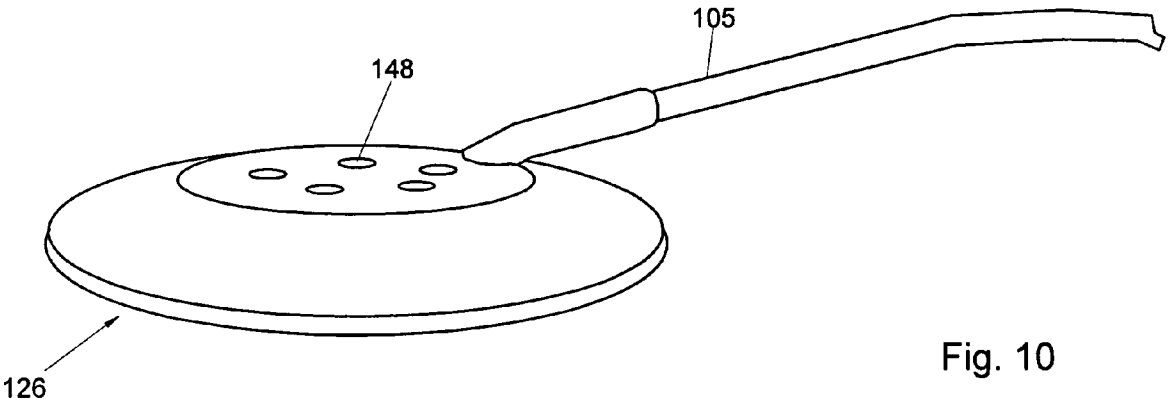
FIG. 10 schematically shows, in perspective top plan view, an alternative, one-piece embodiment of a connecting device according to the invention.
Figure 11:
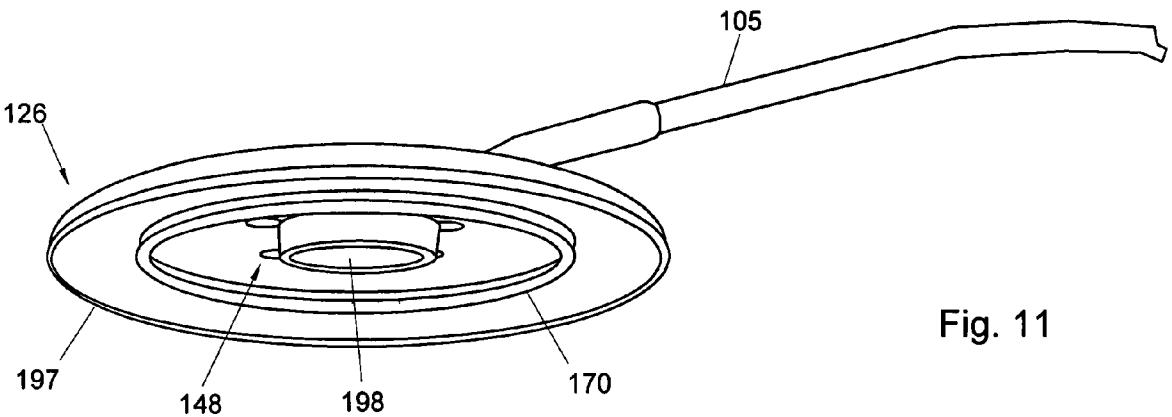
FIG. 11 shows, in perspective bottom view, the connecting device according to FIG. 10.
Figure 12:
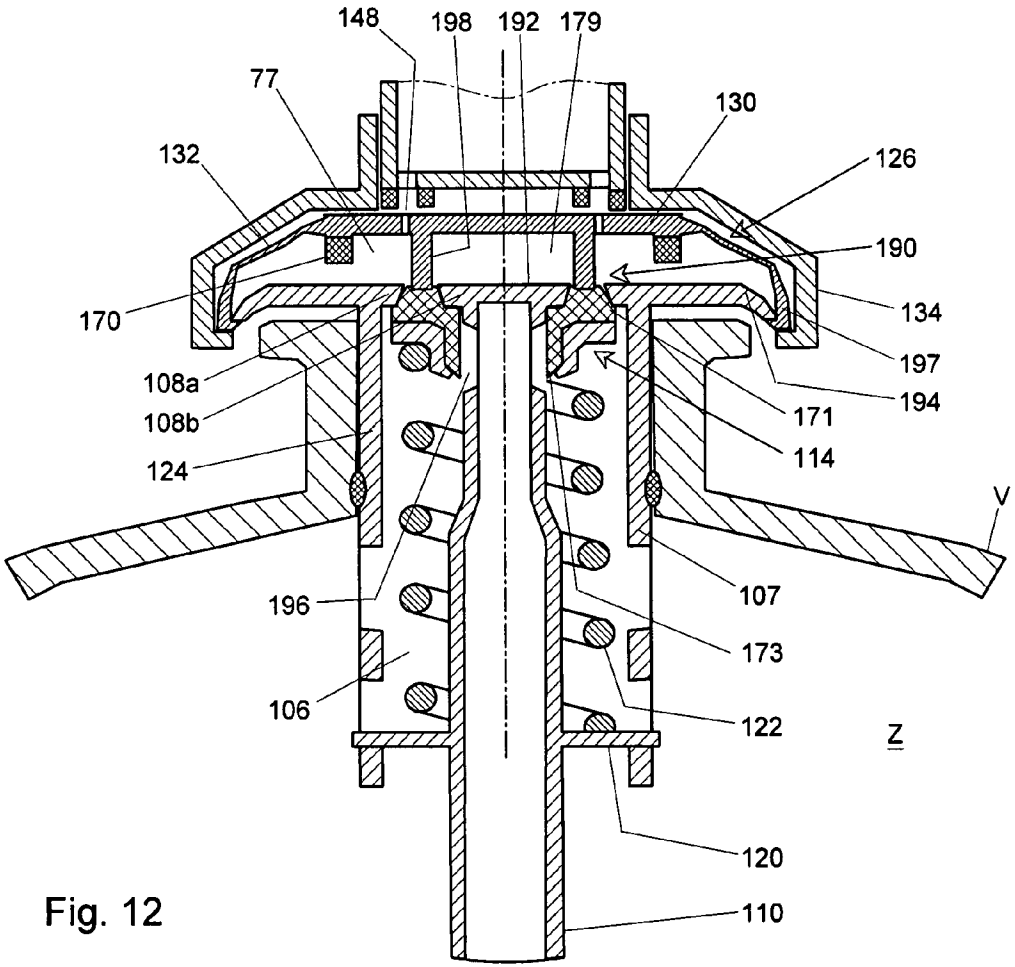
FIG. 12 shows, in sectional side elevation, a connecting device according to FIGS. 10 and 11 as a part of a tapping rod with a flat top, with a portion of a tapping head, in closed position.
Figure 13:
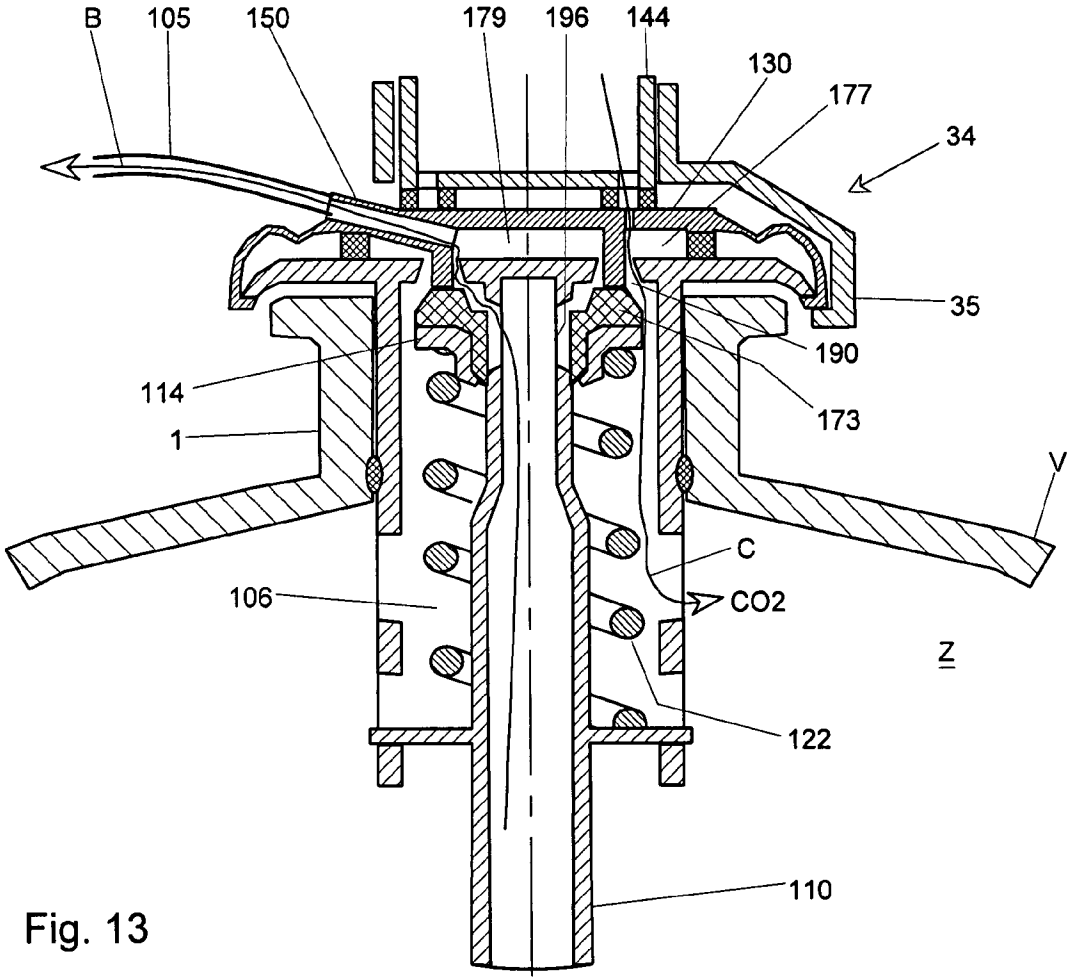
FIG. 13 shows the assembly according to FIG. 12, in opened condition, rotated through 90°.
Figure 14A:
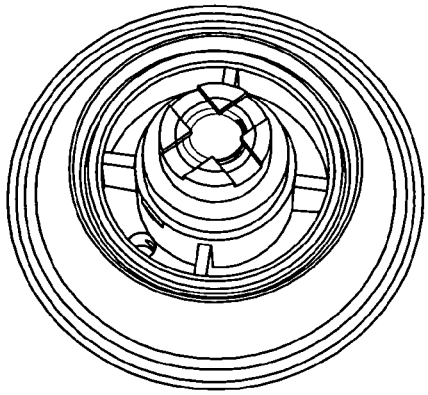
FIGS. 14*a-c* show in bottom view, side elevation, and perspective top plan view, respectively, an alternative embodiment of a connecting device according to the invention.
Figure 14B:
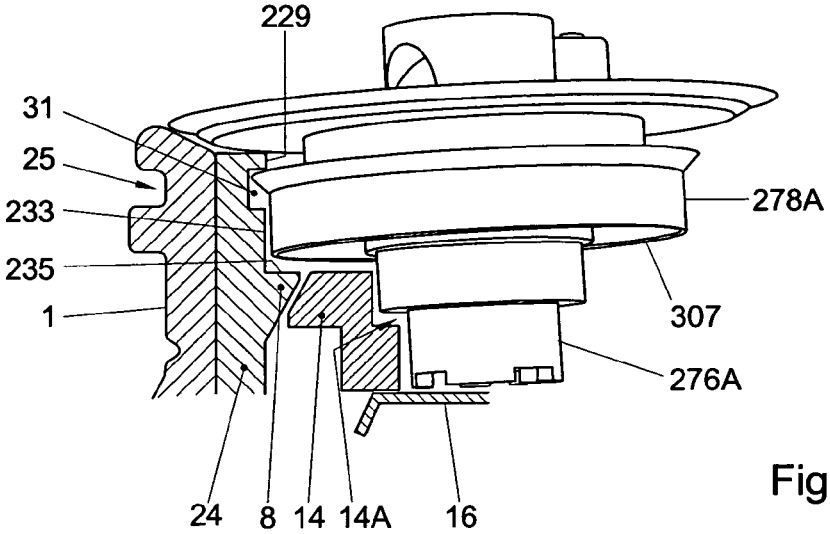
Figure 14C:
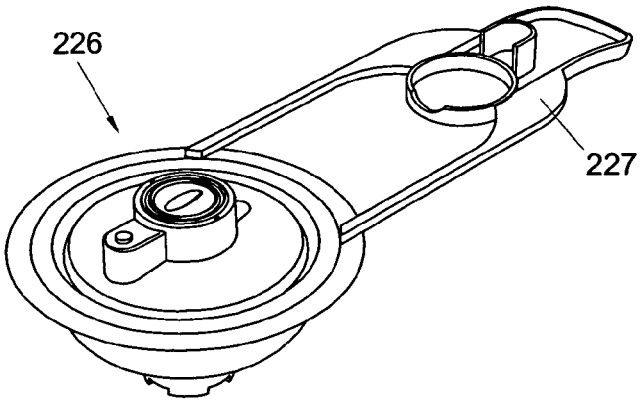

In FIGS. 10 and 11 there is shown, in perspective plan and bottom view, respectively, a further alternative embodiment of a connecting device 126 according to the invention, with a beverage line 105 fixedly connected thereto. The connecting device 126 proper, apart from a packing ring 170, is manufactured in one piece. Optionally, the packing ring 170 may have been injection molded onto the rest of the connecting device 126, for instance through 2K injection molding technique. However, it may also be a loose packing ring 170. In FIGS. 12 and 13, such a connecting device is shown, in cross section, during use in closed and open condition, respectively. A tapping head 34 is used here, comparable to that shown in FIG. 1, which tapping head 34 is represented only in part. This connecting device 126 comprises a centrally located, relatively stiff first part 130, surrounded by a flexible second part 132 which constitutes movement means for the connecting device 126. In this embodiment of the tapping rod, the riser 110 is integrated with the locking plate 120, secured adjacent the lower end of the chamber 106. Confined in the chamber 106 is a spring 122, by which a valve 114 is biased into a closed position, which valve 114 constitutes a gas valve and a beverage valve at the same time. This valve 114 is substantially annular and comprises a stiff part, carried by the spring 122, with a packing 171 thereon. This packing is annular and fits into a slit-shaped opening 190 provided between a locking plate 192 on the upper end of the riser 110 and a locking ring 194 surrounding the locking plate 192, which locking ring 194 links up with the longitudinal wall 107 of the chamber 106. The packing 171 closes the annular opening 190 with a proper fit and is provided with a downwardly directed skirt 173. Under the locking plate 192, passage openings 196 are provided in the wall of the riser 110, which are at least partly closed of by the skirt 173. This will be further discussed hereinafter. It will be clear that the mutually facing longitudinal edges of the locking plate 192 and the locking ring 194 constitute first and second valve seats for the valve 114.

From the underside of the stiff first part 130 extends a first edge 198, with a diameter such that this first edge 198 can engage the upper side of the packing 171, in the annular opening 190. At some distances, the first edge 198 is surrounded by a second edge, formed by said packing 170. This packing 170 has a height smaller than the height of the first edge 198. Between the first edge 198 and the second edge 170 extend gas channels 148, which terminate in a gas supply chamber 77 formed between the fist edge 198 and the packing 170. Within the first edge 198, a beverage chamber 179 is formed. The movement means 132 are provided at their free longitudinal edge with a clamping edge 197, which functions as fastening means with which the connecting device 126 can be secured under the longitudinal edge of the locking ring 194, as shown in FIGS. 12 and 13. The beverage dispensing line 105 links up via a first beverage channel 150 with the beverage chamber 179. The tapping head 134 is secured through a somewhat horseshoe-shaped shoe 36 under the fastening means 197 and the free longitudinal edge of the closing 194. Again, an operating rod 144 is provided which can be moved axially in the manner described earlier, against the relatively stiff first part 130. Through the operating rod 144, pressure gas, in particular $CO_2$, can be supplied to the gas channels 148, FIG. 13 shows the connecting device, with the valve open. Here, the operating rod 144 has been moved down, such that the first edge 198 abuts against the packing 171 and the valve 114 is moved down such that the skirt 173 links up under the lower longitudinal edge of the passage 196. Above the skirt 173, a portion of the passage opening 196 is then left clear. Accordingly, beverage, as shown by the arrow B, can flow up through the riser 110, via the passage openings 196 along the first edge 198 into the beverage chamber 179 and hence away via the first beverage channel 150 and the beverage line 105. At the same time, a pressure gas such as $CO_2$ can flow from the operating rod 144 through the gas channels 148 into the gas supply chamber 177, then through the annular opening 190 and the valve 114 into the chamber 106 and hence into the inner space Z of the keg V. The flow of the pressure gas is represented in FIG. 13 by the arrow C. As a result of the position of the packing 171 and the first edge 198 linking up therewith in a sealing manner, a complete separation between the pressure gas flow and the beverage flow C, B has been obtained.

Figure 15:
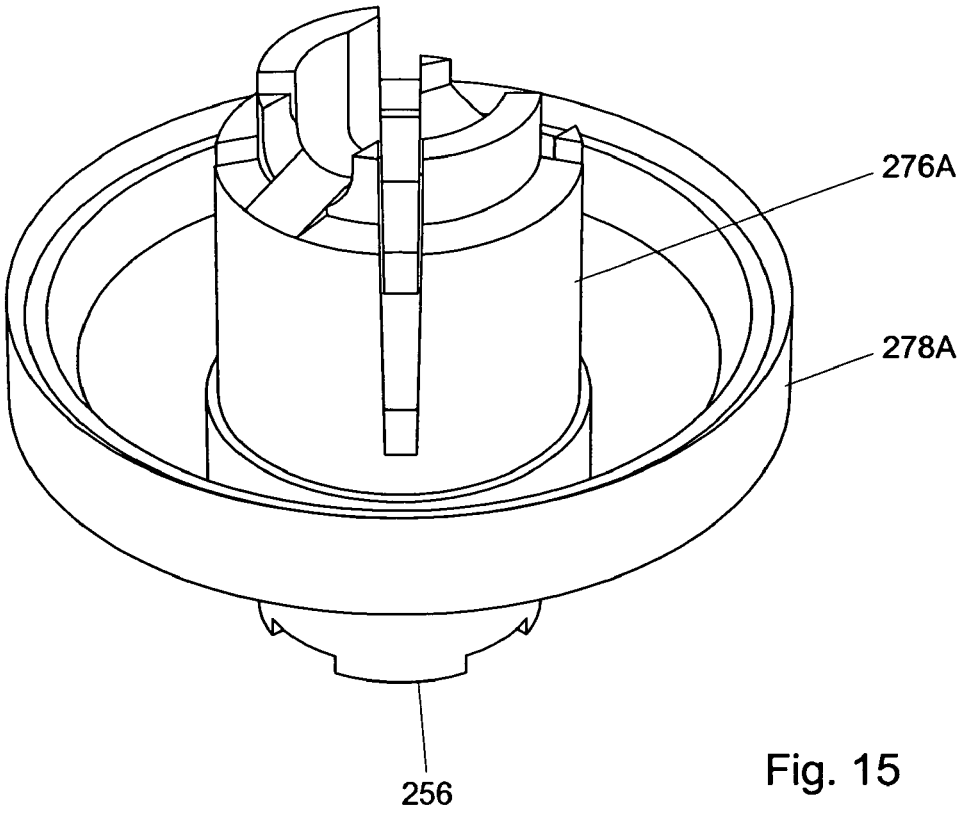
FIG. 15 shows, in perspective view, sealing means of a connecting device according to FIG. 14.
Figure 15A:
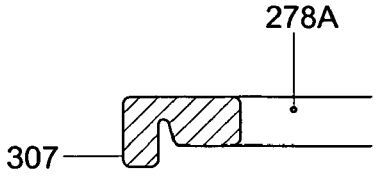
Figure 16:
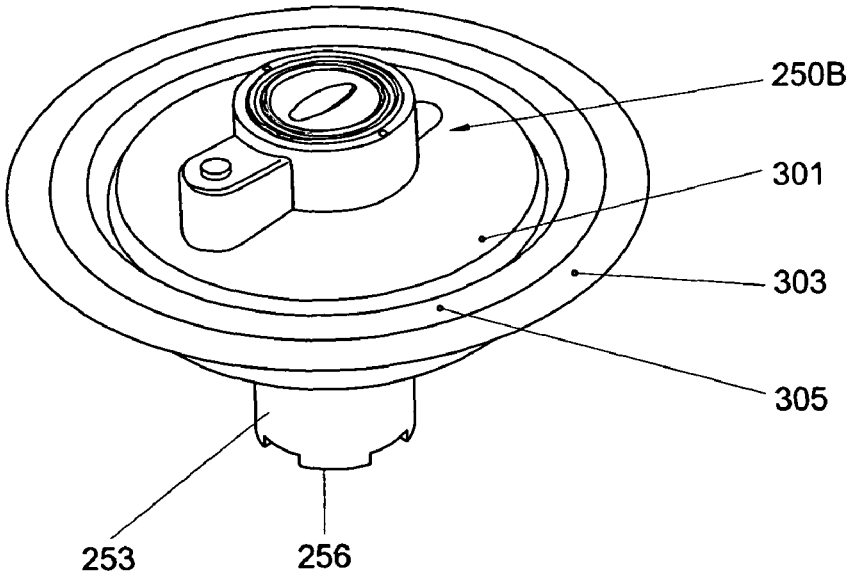
FIG. 16 shows, in perspective top plan view and bottom view, a plastic part of a connecting device according to FIG. 14.
Figure 16:
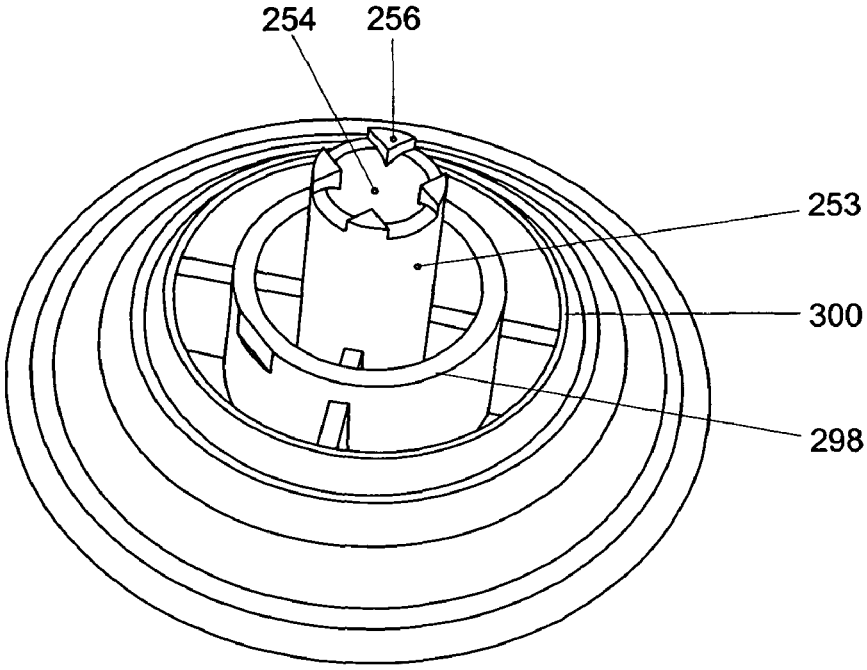
Figure 17:
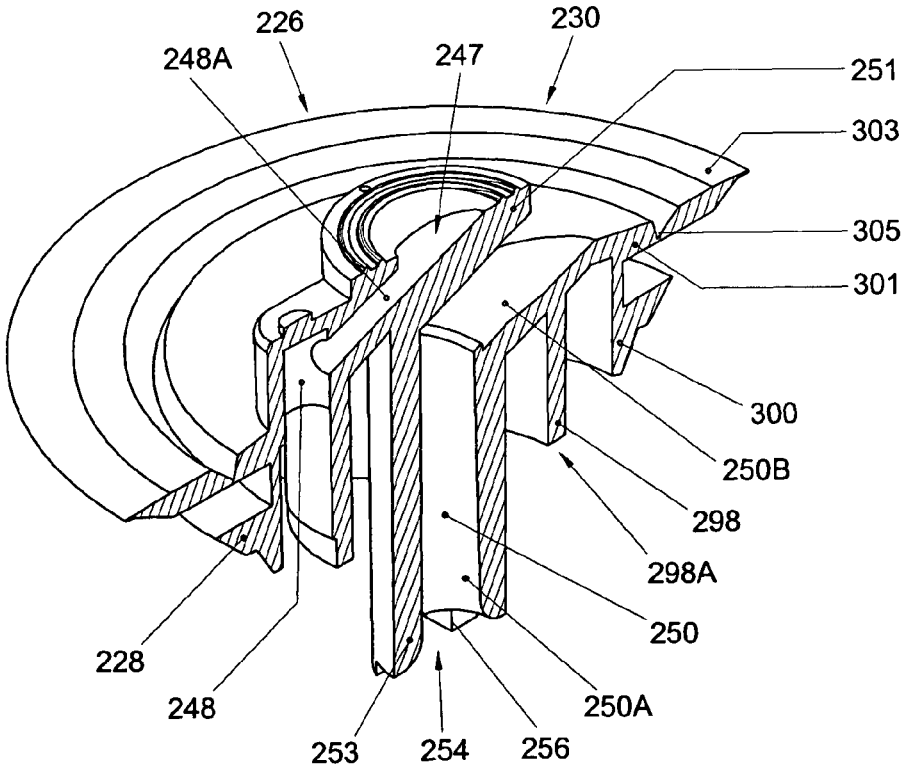
FIG. 17 shows the plastic part according to FIG. 16 in perspective sectional elevation.
Figure 18:
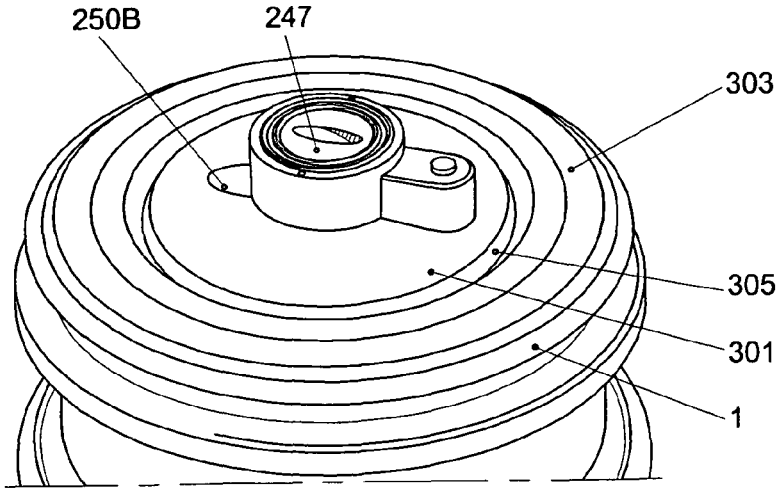
FIG. 18 shows, in perspective top plan view, a connecting device according to FIGS. 14-17, placed on a neck of a keg.
Figure 19:
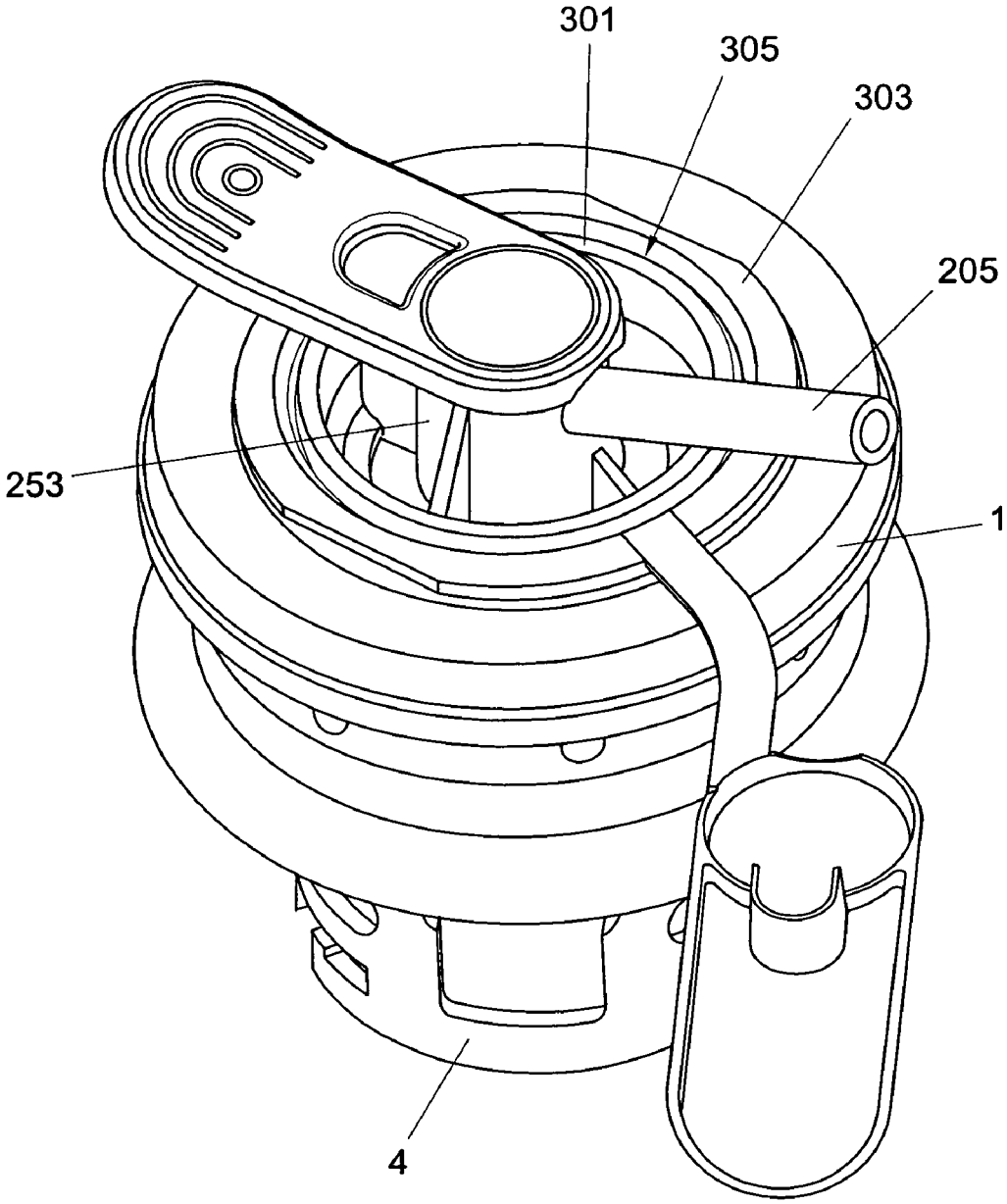
FIG. 19 shows, in perspective top plan view, a connecting device according to the invention, in a further alternative embodiment, with covering lid.

In FIGS. 14-18, a further alternative embodiment of a connecting device 226 for a tapping head according to the invention is shown, in this embodiment applicable instead of a connecting device 26 in FIGS. 1 and 2. In FIG. 14A the underside of such a connecting device 226 is shown. In FIG. 14B, this connecting device is shown substantially in side elevation, while on the left-hand side there has been drawn, in cross section, a neck 1 with collar 24, gas valve 14 and beverage valve 16, as also shown in FIGS. 1 and 2. In FIG. 14C the connecting device 226 is shown in perspective top plan view, with a one-piece integrally injection molded cover 227. This connecting device 226 is preferably injection molded with a 2-component technique (2K), to form a relatively hard plastic part and a relatively soft sealing part, which parts are shown in FIGS. 16 and 15, respectively. FIG. 17, shows the relatively stiff part 230 in perspective cross-sectional elevation. This part 230 comprises a beverage channel 250 which is slightly angled and comprises a first axial part 250A, as well as a second channel part 250B extending radially therefrom at an angle of, for instance, 30° to 45°. In this second channel part 250B, a beverage dispensing line can be secured. Viewed radially, at some distance from the beverage channel 250, there extends a gas channel 248, which is angled such that a gas inlet 247 is provided, centrally on top of the connecting device 226. The inclined part 248A of the gas channel 248 is separated from the second part 250B of the beverage-channel by a wall 251. The beverage channel 250 is surrounded by a cylindrical wall 253, while a first cylindrical wall 298 surrounds the wall 253 concentrically at some distance, The axial height of the first edge 298 is smaller than the axial length of the wall 253, such that the beverage channel has a beverage inlet opening 254 which is located considerably lower than the lower edge 298A of the first edge 298. The first edge 298 is again surrounded at some radial distance by a second edge 300, connected with the first wall 298 and the wall 253 by way of a substantially circular surface 301 extending at right angles to the longitudinal axis of the beverage channel 250A, which surface is surrounded by a breaking ring 303, connected with the surface 301 by way of a relatively thin, simply breakable breaking edge 305. The breaking edge 305 has a thinning configuration in outward direction and can fittingly abut against the upper side of the neck 1, as shown in FIG. 14B. As a result, a complete closure of the neck 1 is obtained. This is clearly visible in FIG. 18. In FIG. 15 a relatively flexible, sealing part is shown for use with a connecting device 226 according to FIG. 14. It comprises a first packing 276A, which fittingly links up with the first edge 298 and surrounds the tall 253 completely, including the square teeth 256. A second packing 278A is provided, which is secured against the edge 300. This packing has a cross section which is schematically shown in FIG. 15A. Provided along the outer longitudinal edge which faces downwards during use is a flexible lip 307, which has a height chosen to be relatively great. Upon placing the connecting device 226 in the neck 1, as shown in FIG. 14B, a circumferential projecting edge 229, comparable to the edge 29 as shown in FIG. 9A, engages in the groove 31. The packing 278A then abuts against the wall part 233 extending under the groove 31. The height of the lip 307 is at least equal to and preferably slightly greater than the height of the wall part 233 and chosen to be at least such that when the projecting edge 229 abuts against the upper edge of the groove 31, the lip 307 abuts sealingly against the wall part 233. When the connecting device 226 is moved axially downwards, against the gas valve 14 and the beverage valve 16, the lip 307 will run against the upper surface 235 of the seat 8. Upon further downward movement, the lip 307 will be upset against the upper surface 235, so that a complete sealing is obtained. The first packing part 276A then engages the inner side 14A of the gas valve 14, while the square teeth 256 abut against the beverage valve 16. As a result, a complete separation between beverage channel 250 and gas channel 248 is obtained. Of course, the parts as shown in FIG. 15 can also be injection molded as loose items and subsequently be mounted on the relatively stiff part as shown in FIG. 16. The lid 227 can be pressed onto the upper side of the connecting device 226, as shown schematically in FIG. 19, so that at least the gas inlet 247 is protected from contamination. In FIG. 19 a same cover is shown in open position, in an alternative embodiment. In FIG. 19, further, the beverage line 205 is clearly shown. In the embodiment shown in FIG. 19, the connecting device 226 is designed to be slightly concave at the top.

Figure 20:
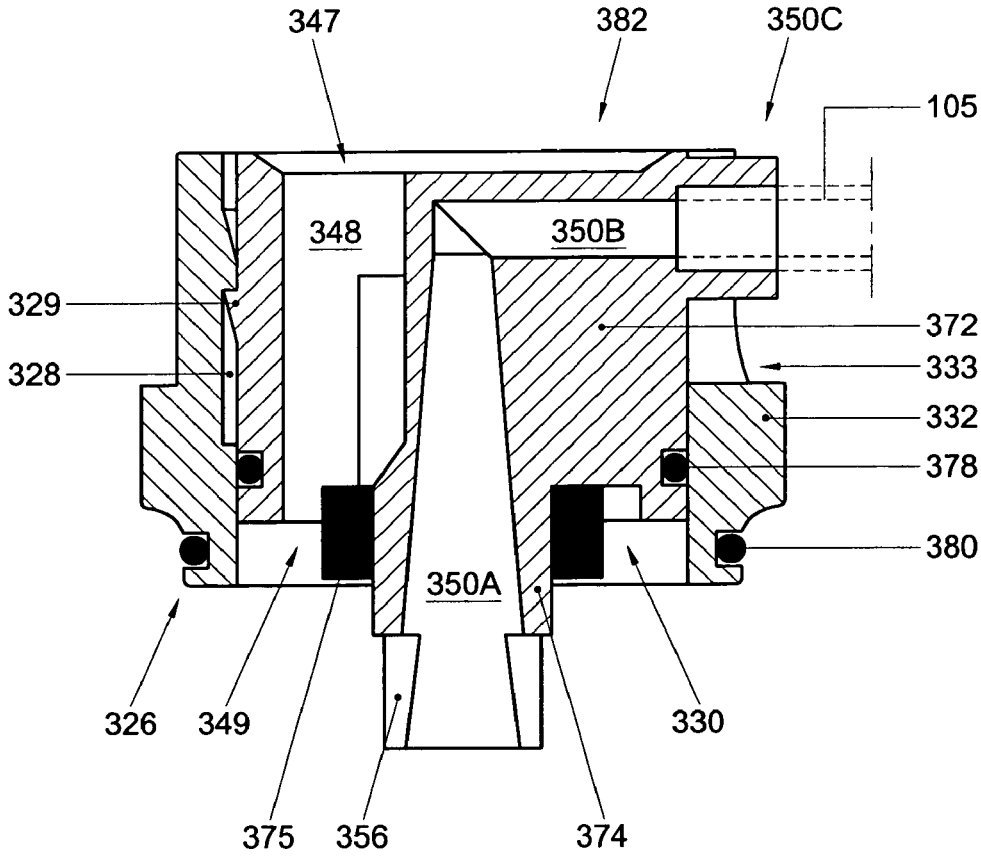
FIG. 20 shows, in sectional side elevation, a further alternative embodiment of a connecting device according to the invention.

Upon moving the connecting device 26 axially downwards for the first time, the breaking ring 303 will break, at least be torn loose, along the breaking edge 305, so that it is immediately clear whether a keg provided with this connecting device 226 has already been manipulated. The breaking ring 303 therefore functions as sealing means. This connecting device can be manufactured and used in a particularly simple manner, can advantageously be injection molded and is particularly hygienic in use, FIG. 20 shows in sectional side elevation a still further alternative embodiment of a connecting device 326 according to the invention, applicable in an assembly according to FIGS. 1 and 2, instead of the connecting device shown therein. In this embodiment, a substantially cylindrical fixing body 332 is provided, as well as a pressure body 330 axially movable therein with a proper fit. The pressure body 330 comprises a substantially cylindrical first part 372 which is axially movable within the fixing part 332 and is in sealing contact therewith through a packing 378. Extending downwards from the cylindrical first part 372 is a cylindrical second part 374, having a considerably smaller diameter than the first part 372. A beverage channel 350 extends through the pressure part 330 and is elbow-shaped, hang an a fist part 350A and a radial second part 350B, in which again a beverage dispensing be 105 (represented in broken lines) can be fixed. Provided on the inside of the fixing element 332 is a groove 328 in which a projecting edge 329 of the first part 372 of the pressure body 330 can engage, such that the pressure body 330 cannot move out of the fixing body 332. Provided in the wall of the fixing body 332 is a recess 333 in which the end 350C of the second part 350B of the beverage channel 350 can move. In the upper position shown in FIG. 20, the upper surface 382 of the pressure body 330 is flush with the upper edge of the fixing body 332. The pressure body 330 can be moved down axially, in the manner described earlier, to the extent where the end 350C of the beverage channel 350 butts against the bottom of the recess 333. The fixing body 332 can be secured in the collar 24, with a second packing 380 providing a sealing against it. Provided around the second cylindrical part 374 is a pressure ring 375 which can operate the gas valve, in the manner described earlier. This pressure ring 375 is preferably slightly elastic, thereby providing a sealing against the gas valve. Through the cylindrical first part 372 extends a gas channel 348 with a gas inlet 347, an upper surface 382 and a gas outlet 349 next to the pressure ring 375. Two square tooth-shaped elements 356 are provided on the cylindrical second part 374, for the purpose described earlier.

As appears clearly from the description, with a tapping head according to the invention, only a gas connecting tube is connected with the tapping head, while the beverage dispensing line is connected with the connecting device. The flow path of the beverage is separated from the flow path of the gas, so that contamination of the tapping head is prevented. The tapping rod is carried off along with the keg, so that at the same time the connecting device is carried off. This means that the tapping head does not come into contact with the beverage and hence does not need to be cleaned, or only minimally so. It is then preferred that the beverage dispensing line is then carried off as well, as described, for instance, in applicant's non-prepublished Dutch patent application entitled "Tapping device and container therefor, and method for the manufacture thereof", filed 31 May 2000, incorporated herein by reference.

The invention is not limited in any way to exemplary embodiments represented in the description and the drawing. Many variations thereon are possible Thus, tapping heads and valve systems of a different kind can be used in connecting devices according to the invention. Also, the beverage channels, gas channels and fixing means can be constructed in many other ways. Other non-return valves or like means to prevent beverage flowing into the gas channels can be used, such as, for instance, a non-return valve in the or each gas channel. Further, fastening means of a different kind can be used for fixing the tapping rod in the keg, for instance a bayonet catch, a glued joint, clamped joints or the like.

These and many comparable variations are understood to fall within the scope of the invention as outlined by the claims.

The invention claimed is:

1. An assembly comprising:

a tapping rod including a chamber that can be placed in fluid communication with a beverage in a container having a neck;

a riser having one end of which is located in the chamber of the tapping rod and the other end of which can be placed in fluid communication with the beverage in the container;

a gas valve located in the tapping rod for allowing gas to flow into the chamber of the tapping rod and out of the chamber into the beverage in the container when the gas valve is open and for closing off the flow of gas to the chamber of the tapping rod when the gas valve is closed;

a beverage valve located at or within the end of the riser that is located in the chamber of the tapping rod for allowing the beverage to flow into and through the riser when the beverage valve is open and for closing off the flow of the beverage through the riser when the beverage valve is closed; and a connecting device connected to the tapping rod or the neck and a pressure body provided between the connecting device and the beverage valve and gas valve for opening and closing the gas valve and the beverage valve, the pressure body having at least one beverage channel for placing the beverage in the container in fluid communication, through the riser, with a beverage dispensing line when the beverage valve is open and at least one gas channel effective to place the beverage in the container, when the gas valve is open, in fluid communication, through the chamber of the tapping rod and through the open gas valve, with a gas supply line, wherein said beverage valve is sealingly pressable against said gas valve, the pressure body being movable axially with respect to the neck of the container, at least part of the gas channel being located inside the pressure body.

2. The assembly of claim 1 wherein the tapping rod includes a collar portion located above the chamber in the tapping rod and the connecting device is located in the collar portion of the tapping rod.

3. The assembly of claim 1 wherein the at least one beverage channel and the at least one gas channel are separated from each other, both in the open and in the closed position of the beverage valve and the gas valve.

4. The assembly of claim 2 wherein the pressure body is surrounded by a fixing element which is lockable within or on the collar portion such that the fixing element is substantially fixed in position in an axial sense.

5. The assembly of claim 4 wherein the fixing element includes a beverage channel which, when the beverage valve is open, links up with the at least one beverage channel in the pressure body.

6. The assembly of claim 5 wherein a beverage dispensing line is fixedly connected with the beverage channel in the fixing element.

7. The assembly of claim 1 wherein a beverage dispensing line is connected directly with the beverage channel in the connecting device.

8. The assembly of claim 2 wherein the beverage valve seals against the gas valve, while the gas valve seals against the collar; wherein upon moving the gas valve away from the collar, the gas valve is opened, and upon moving the beverage valve relative to the gas valve, the beverage valve is opened, the gas valve comprising a gas valve body which comprises an opening through which the pressure body is movable against a beverage valve body of the beverage valve for opening the beverage valve, and the pressure body comprising a pressure edge movable against the gas valve body for opening the gas valve.

9. The assembly of claim 8 wherein the pressure edge is movable against a longitudinal edge of said opening, for opening the gas valve, the pressure edge sealing substantially fluid-tightly against said longitudinal edge.

10. The assembly of claim 8 wherein the distance between the end of the pressure body located, during opening of the beverage valve, against the beverage valve body and the pressure edge is chosen such as to be greater than the relevant distance between the beverage valve body against which the pressure body abuts and the part of the gas valve against which the pressure body abuts during opening of the gas valve, the arrangement being such that upon movement of the pressure body for opening the valves, first the beverage valve and then the gas valve is opened.

11. The assembly of claim 1 wherein the at least one gas channel has a first end terminating in or near an upper surface of the pressure body, while the beverage dispensing line is connectible or connected to the pressure body at a radial distance from the longitudinal axis of the pressure body greater than the radial distance from said longitudinal axis to the termination of the at least one gas channel in or near said upper surface.

12. The assembly of claim 1 wherein a first and second beverage channel, respectively, to which the beverage dispensing line is connected includes an angle, at least near said connection, with the longitudinal axis of the pressure body, the arrangement being such that the beverage dispensing line is connectible or connected to the respective beverage channel with a feed-through direction adjacent said connection which has at least a radial component.

13. The assembly of claim 1 wherein the pressure body comprises a flange which extends in a direction approximately at right angles to the longitudinal axis of the tapping rod and seals at least gas-tightly against a collar or at least against a fixing body mounted therein, while the at least one gas channel has a second end terminating between said flange or at least seal, and the gas valve or at least a gas valve body.

14. The assembly of claim 1 wherein the at least one beverage channel comprises a portion located centrally in the pressure body, with a first end in or near a lower surface of the pressure body, surrounded by square tooth-shaped elements which during use keep said first end spaced from a beverage valve body or the beverage valve.

15. The assembly of claim 1 wherein the passage of the at least one gas channel is smaller than that of the at least one beverage channel.

16. The assembly of claim 2 wherein the pressure body and/or the collar portion is/are provided with cooperating sealing means, such that through rupture or loosening of the cooperating sealing means, it becomes visible that the pressure body has been moved at least once in a direction of a position needed for opening the beverage valve and/or the gas valve.

17. The assembly of claim 1 wherein means are provided for preventing ingress of beverage into the at least one gas channel in the connecting device.

18. The assembly of claim 17 wherein the at least one gas channel is provided with a non-return valve.

19. The assembly of claim 17 wherein a flexible element extends around at least a portion of the connecting device, such that an outflow opening of the at least one gas channel is closed off thereby when no gas is being supplied, while the flexible element can be pushed away slightly when gas under pressure is being supplied through the at least one gas channel, for allowing said pressure gas to pass.

20. The assembly of claim 1 wherein the container comprises a keg and the assembly is connected to the keg.

21. The assembly of claim 20 including a tapping head, wherein the tapping head comprises a coupling part for coupling same with a collar of the tapping rod or a neck at least partly surrounding the collar, while an operating rod is provided for pressing the pressure body down for opening the gas valve and the beverage valve, while in or along the operating rod, gas passage openings are provided for passing a gas under pressure through the at least one gas channel into the keg, at least when the gas valve is open.

22. The assembly of claim 12, wherein said angle is between about 30 and about 90°.

23. The assembly of claim 1 wherein means are provided for preventing ingress of beverage into the at least one gas channel in the connecting device during use of the beverage valve and/or gas valve.

24. The assembly of claim 1, wherein the pressure body extends into or through an opening in the gas valve.

25. The assembly of claim 1, wherein the pressure body extends through the gas valve to engage the beverage valve.

26. The assembly of claim 1, wherein, during operation, the pressure body first opens the beverage valve and then, subsequently, opens the gas valve.

* * * * *